US009844789B2

(12) United States Patent
Kakiuchi et al.

(10) Patent No.: US 9,844,789 B2
(45) Date of Patent: Dec. 19, 2017

(54) METHOD OF FORMING LUBRICATIVE PLATED LAYER ON VISCOUS LIQUID FEED NOZZLE AND VISCOUS LIQUID FEED NOZZLE

(71) Applicant: NHK Spring Co., Ltd., Yokohama-shi, Kanagawa (JP)

(72) Inventors: Shinpei Kakiuchi, Kanagawa (JP); Eijiro Furuta, Kanagawa (JP); Takashi Ando, Kanagawa (JP)

(73) Assignee: NHK Spring Co., Ltd., Kanagawa (JP)

( * ) Notice: Subject to any disclaimer, the term of this patent is extended or adjusted under 35 U.S.C. 154(b) by 237 days.

(21) Appl. No.: 14/154,286

(22) Filed: Jan. 14, 2014

(65) Prior Publication Data

US 2014/0124545 A1 May 8, 2014

Related U.S. Application Data

(62) Division of application No. 13/300,337, filed on Nov. 18, 2011, now Pat. No. 8,859,039.

(30) Foreign Application Priority Data

Dec. 27, 2010 (JP) ..... 2010-291212

(51) Int. Cl.
*B05B 1/30* (2006.01)
*C23C 18/16* (2006.01)
*C23C 18/32* (2006.01)

(52) U.S. Cl.
CPC ..... *B05B 1/30* (2013.01); *C23C 18/1655* (2013.01); *C23C 18/1662* (2013.01); *C23C 18/1664* (2013.01); *C23C 18/32* (2013.01)

(58) Field of Classification Search
CPC ..... B05B 1/30; B05C 5/02; C23C 18/1655; C23C 18/1662; C23C 18/1664; C23C 18/32
See application file for complete search history.

(56) References Cited

U.S. PATENT DOCUMENTS 3,658,663 A 4/1972 Fukanuma et al.
4,750,675 A 6/1988 Sczomak
(Continued)

FOREIGN PATENT DOCUMENTS

DE WO 9526237 A1 * 10/1995 ..... B05C 5/02
JP 3018447 9/1995
(Continued)

*Primary Examiner* — Frederick C Nicolas
*Assistant Examiner* — Bob Zadeh
(74) *Attorney, Agent, or Firm* — Norris McLaughlin & Marcus, P.A.

(57) ABSTRACT

A viscous liquid feed nozzle has a nozzle body having a thin and long hole with a front end serving as a feed port. The nozzle is used with a viscous liquid feed unit to feed a viscous liquid such as a viscous adhesive from the feed port. The nozzle has a lubricative plated layer at least on the inside and outside of the feed port. The lubricative plated layer is formed by electroless plating by immersing the nozzle in a plating tank containing a lubricative plating solution. A base end of the nozzle body may have a wide port. In this case, the lubricative plated layer is formed by immersing the nozzle body in the plating tank containing the lubricative plating solution so that the lubricative plating solution enters the wide port and by applying pressure or gravity to the lubricative plating solution in the wide port to pass the lubricative plating solution through the thin and long hole of the nozzle body and discharge the same from the feed port. The viscous liquid feed nozzle with the lubricative plated layer is capable of stably feeding a very small quantity of a viscous liquid.

12 Claims, 2 Drawing Sheets

(56) References Cited

U.S. PATENT DOCUMENTS

| | | | | |
|---|---|---|---|---|
| 4,830,889 | A | 5/1989 | Henry et al. | |
| 4,859,494 | A * | 8/1989 | Lancsek | C23C 18/1662 427/304 |
| 6,256,883 | B1 * | 7/2001 | Kinoshita | B41J 2/1606 205/158 |
| 8,444,936 | B2 | 5/2013 | Taniguchi et al. | |
| 8,859,039 | B2 * | 10/2014 | Kakiuchi | C23C 18/32 118/400 |
| 2001/0007171 | A1 * | 7/2001 | Kinoshita | B41J 2/1606 29/729 |
| 2005/0017099 | A1 | 1/2005 | Batich et al. | |
| 2006/0091016 | A1 | 5/2006 | Avery et al. | |
| 2007/0264491 | A1 * | 11/2007 | Asano | C23C 18/1628 428/327 |
| 2012/0164325 | A1 * | 6/2012 | Kakiuchi | C23C 18/32 427/230 |
| 2013/0143031 | A1 * | 6/2013 | Sorbo | C23C 18/34 428/323 |
| 2013/0177777 | A1 * | 7/2013 | Cao | C23C 18/36 428/565 |
| 2014/0124545 | A1 * | 5/2014 | Kakiuchi | C23C 18/32 222/566 |
| 2014/0248432 | A1 * | 9/2014 | Franke | C23C 18/32 427/299 |

FOREIGN PATENT DOCUMENTS

| | | |
|---|---|---|
| JP | 11-007897 | 1/1999 |
| JP | 11-330679 | 11/1999 |
| JP | 2003-056431 | 2/2003 |
| WO | WO-95/26237 | 10/1995 |
| WO | WO-2010/109927 | 9/2010 |

* cited by examiner

METHOD OF FORMING LUBRICATIVE PLATED LAYER ON VISCOUS LIQUID FEED NOZZLE AND VISCOUS LIQUID FEED NOZZLE

REFERENCE TO RELATED APPLICATION

This is a divisional application of Ser. No. 13/300,337, filed Nov. 18, 2011, which is currently pending. The subject matter of the aforementioned prior application is hereby incorporated herein by reference.

BACKGROUND OF THE INVENTION

1. Field of the Invention

The present invention relates to a method of forming a lubricative plated layer on a viscous liquid feed nozzle and the viscous liquid feed nozzle itself, the viscous liquid feed nozzle is used when manufacturing, for example, a head suspension that is arranged in a disc drive incorporated in an information processor such as a personal computer.

2. Description of Related Art

The viscous liquid feed nozzle is installed on a viscous liquid feed unit and is used to feed, for example, a viscous adhesive to attach a piezoelectric element to a head suspension employing a dual actuator system.

The piezoelectric element is very small, and therefore, the viscous liquid feed nozzle must feed a very small quantity of viscous adhesive to the piezoelectric element. For this, the nozzle is thin and long and has a large aspect ratio with, for example, about 0.05 to 0.4 mm in inner diameter and several millimeters in length. When repeatedly feeding a small quantity of viscous adhesive, the nozzle is entangled with the adhesive that forms threads or balls to destabilize the feeding of the adhesive in a predetermined quantity.

To solve this problem, Japanese Unexamined Patent Application Publication No. H11-07897 discloses a nozzle made of a water repellent material and a nozzle whose front end is coated with a water repellent material. Also, Japanese Unexamined Patent Application Publication No. H11-330679 discloses a nozzle whose inner circumference is provided with water repellence.

Nozzles having a relatively large inner diameter such as 0.5 mm may be producible from a water repellent material. Nozzles having smaller diameters, however, are difficult to produce from a water repellent material. Even if they are producible from, for example, water repellent resin, they have low rigidity and are improper for precise positioning when applying a viscous liquid to a small object such as the piezoelectric element.

Water repellence of the viscous liquid feed nozzle is generally realized by coating the nozzle with a fluorine film such as a Teflon (registered trademark) film. The fluorine coating is difficult to carry out on the inner circumference of a thin and long nozzle having a large aspect ratio of 0.05 to 0.4 mm in inner diameter and several millimeters in length.

Furthermore, the fluorine coating is usually carried out by powder coating or electrostatic spraying. These coating techniques are hardly applicable to the inner circumference of a very small hole of the nozzle.

This is because the powder coating is unable to uniformly supply powder into the small hole. In the case of the electrostatic spraying, a problem occurs as illustrated in FIG. 5. Namely, the electrostatic spraying causes a concentration of power lines at a front end 103 of a nozzle 101 to partly thicken the coating at the front end 103. On the other hand, no power line enters a very small hole 105 of the nozzle 101, so that no coating is formed in the hole 105. The thickened coating 107 at the front end 103 of the nozzle 101 increases a risk of blocking a feed port of the hole 105.

The thickened coating 107 at the front end 103 will form threads or balls to further destabilize a quantity of viscous liquid to be fed from the nozzle 101.

In addition, the fluorine coating needs a baking process that is carried out at about 400 degrees centigrade, and therefore, is inapplicable to a nozzle that is already heat-treated.

An immersion technique may be employed to form a water repellent coating on the viscous liquid feed nozzle. This technique applies liquid paint to the nozzle and dries the paint on the nozzle, and therefore, the technique has a risk of closing a small hole (105 of FIG. 5) of the nozzle with the paint.

SUMMARY OF THE INVENTION

An object of the present invention is to provide a viscous liquid feed nozzle capable of stably feeding a very small quantity of a viscous liquid.

In order to accomplish the object, a first aspect of the present invention provides a method of forming a lubricative plated layer on a viscous liquid feed nozzle that has a nozzle body having a thin and long hole with a front end serving as a feed port and is used with a viscous liquid feed unit to feed a viscous liquid from the feed port. The method includes steps of immersing the viscous liquid feed nozzle in a plating tank containing a lubricative plating solution and forming, by electroless plating, the lubricative plated layer at least on the inside and outside of the feed port.

A second aspect of the present invention provides a viscous liquid feed nozzle having a lubricative plated layer formed according to the first aspect of the present invention. The viscous liquid feed nozzle has a nozzle body that is provided with a thin and long hole with a front end serving as a feed port and a wide port formed at a base end of the nozzle body. The lubricative plated layer is formed at least on the inside and outside of the feed port.

According to the first aspect, the method is capable of easily forming the lubricative plated layer at least on the inside and outside of the feed port of the viscous liquid feed nozzle, so that the viscous liquid feed nozzle stably feeds a viscous liquid even in a very small quantity.

According to the second aspect, the viscous liquid feed nozzle is capable of stably feeding a very small quantity of a viscous liquid with the lubricative plated layer formed at least on the inside and outside of the feed port.

DETAILED DESCRIPTION OF EMBODIMENTS

Embodiments of the present invention will be explained in detail with reference to the drawings. Each embodiment forms a lubricative plated layer on a viscous liquid feed nozzle so that the nozzle stably feeds a small quantity of a viscous liquid.

Figure 1:
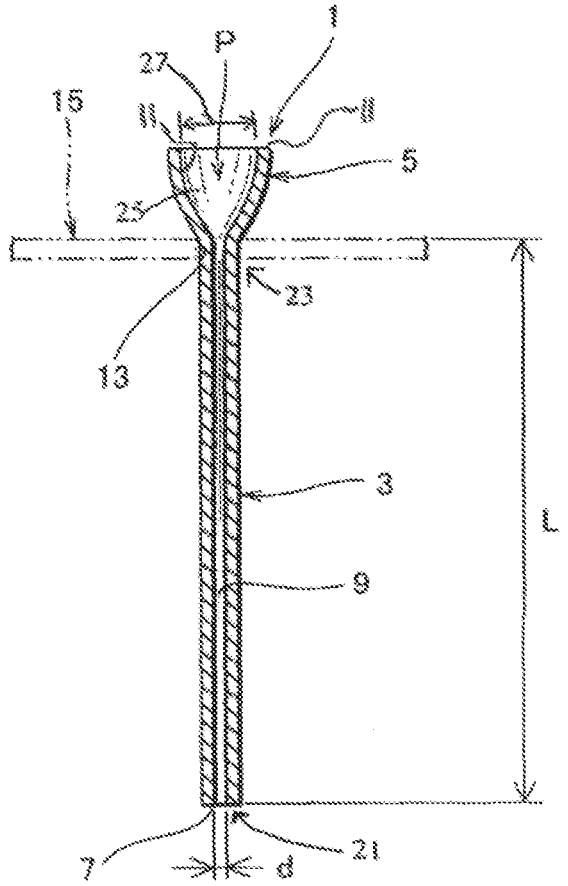
FIG. 1 is a sectional view illustrating a viscous liquid feed nozzle according to an embodiment of the present invention that is supported with a jig.
Figure 2:
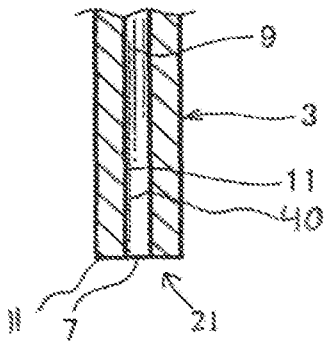
FIG. 2 is a sectional view illustrating a lubricative plated layer on the nozzle of FIG. 1.

FIG. 1 is a sectional view illustrating a viscous liquid feed nozzle according to an embodiment of the present invention and FIG. 2 is a sectional view illustrating a lubricative plated layer formed on the nozzle.

In FIG. 1, the viscous liquid feed nozzle 1 is made of, for example, stainless steel and includes a nozzle body 3 and a wide port 5.

The nozzle body 3 has a thin and long hole 9 with a front end 21 serving as a feed port 7. A length L of the nozzle body 3 is three times or more greater than an inner diameter d of the hole 9 and is within a range to secure rigidity to function as a nozzle. The inner diameter d of the hole 9 is, for example, in the range of about 0.05 to 0.4 mm.

The wide port 5 is formed at a base end 23 of the nozzle body 3 distal to the feed port 7 and has a circular cross section. The diameter of the wide port 5 gradually widens to a diameter 27 toward an open end thereof as illustrated in a longitudinal section of FIG. 1. That is, the diameter of the wide port 5 is greater than that of the hole 9. The wide port 5 may have a circular cross section with a uniform diameter 29 (see FIG. 4) or a square cross section.

The nozzle body 3 and wide port 5 may be separately prepared and fixed together. In this case, the wide port 5 and the nozzle body 3 may be made of different materials. For example, the wide port 5 may be made of resin and fixed to the nozzle body 3 made of stainless steel.

The viscous liquid feed nozzle 1 has a lubricative plated layer 11 at least on the inside and outside of the feed port 7, as illustrated in FIG. 2, such as an inner peripheral surface 40. The lubricative plated layer 11 is a fluorine containing lubricative plated layer, a PTFE composite electroless Ni plated layer, or a KANIFLON (registered trademark) plated layer.

The nozzle 1 is used with a viscous liquid feed unit. The nozzle 1 receives a viscous liquid such as a viscous adhesive supplied from a syringe into the inside space 25 of the wide port 5 and feeds the viscous liquid from the feed port 7 according to, for example, air pressure applied to the syringe.

A method of forming the lubricative plated layer 11 on the viscous liquid feed nozzle 1 will be explained.

The method of the embodiment uses a jig 15 having a support hole 13 through which the nozzle body 3 passes as illustrated in FIG. 1, to support the viscous liquid feed nozzle 1. The jig 15 has a plurality of support holes 13 to support a plurality of viscous liquid feed nozzles 1, respectively. The wide port 5 of each nozzle 1 supported by the jig 15 is oriented upward. FIG. 1 illustrates only one viscous liquid feed nozzle 1, for the sake of simplicity of explanation.

The method of the embodiment also uses a plating tank (not illustrated) that is filled with a lubricative plating solution such as a fluorine containing lubricative plating solution, a PTFE composite electroless Ni plating solution, or a KANIFLON (registered trademark) plating solution.

According to the method, the nozzle 1 supported with the jig 15 is immersed in the lubricative plating solution in the plating tank, to carry out electroless plating. At this time, it is preferable to move the jig 15 up and down within or out of the plating tank, to apply inertial force to the lubricative plating solution introduced or entered in the wide port 5 of the nozzle body 3. Due to this, the lubricative plating solution is pushed into the hole 9 of the nozzle body 3 with pressure P.

The pressure P may be created by applying proper air pressure to the wide port 5 of the nozzle body 3 with a unit that is separately arranged.

The pressure P may be gravity. In this case, the nozzle 1 supported with the jig 15 is immersed in the plating tank so that the lubricative plating solution may enter the wide port 5. Thereafter, the jig 15 with the nozzle body 3 is upwardly pulled out of the plating tank so that the lubricative plating solution in the wide port 5 flows downward by gravity into the hole 9 and is discharged from the feed port 7.

In this way, the method of the embodiment passes the lubricative plating solution through the thin and long hole 9 and flows out of the feed port 7 of the nozzle body 3; preferably by aggressive pressurization or by gravity. Through the steps, the method forms the lubricative plated layer 11 at least on the inside and outside of the feed port 7 as well as on the inside and outside of the wide port 5 by electroless plating.

The electroless plating, in particular, PTFE composite electroless Ni plating or KANIFLON (registered trademark) plating is capable of stably and uniformly forming the lubricative plated layer 11 even on the inside of the thin and long hole 9. Namely, such electroless plating forms the lubricative plated layer 11 of uniform thickness on the inside of the hole 9 and the outside of the feed port 7 and nozzle body 3 without producing a pointed end or a concentration of plating solution that may occur according to the related art.

Figure 5:
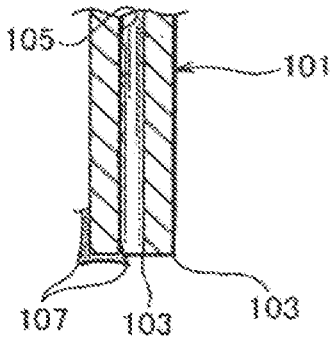
Fig.5 RELATED ART
FIG. 5 is a sectional view partly illustrating a nozzle according to a related art having a concentration of coating due to a concentration of power lines.

The electroless plating according to the embodiment provides the inside of the thin and long hole 9 with water repellence without causing the problem of FIG. 5.

The present invention is applicable to a nozzle body having an inner diameter in the range of 0.05 mm to 0.4 mm and a length three times or more greater than the inner diameter.

The lubricative plated layer 11 formed according to the embodiment on the viscous liquid feed nozzle 1 needs no baking process unlike the fluorine coating. Accordingly, the embodiment is applicable to a nozzle already heat-treated. The heat-treated nozzle that is provided with the lubricative plated layer according to the embodiment realizes both high durability and high dimensional accuracy.

The viscous liquid feed nozzle 1 may be demagnetized to prevent metallic foreign matter from attaching to the nozzle. In this case, the nozzle 1 can be plated according to the embodiment with the use of a general-purpose plating tank instead of an exclusive-use plating tank.

Figure 3:
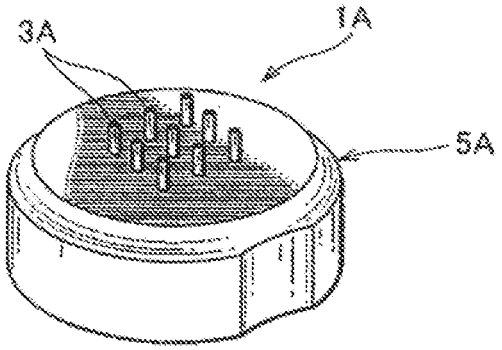
FIG. 3 is a perspective view illustrating a viscous liquid feed nozzle employing a multi-nozzle configuration according to another embodiment of the present invention.
Figure 4:
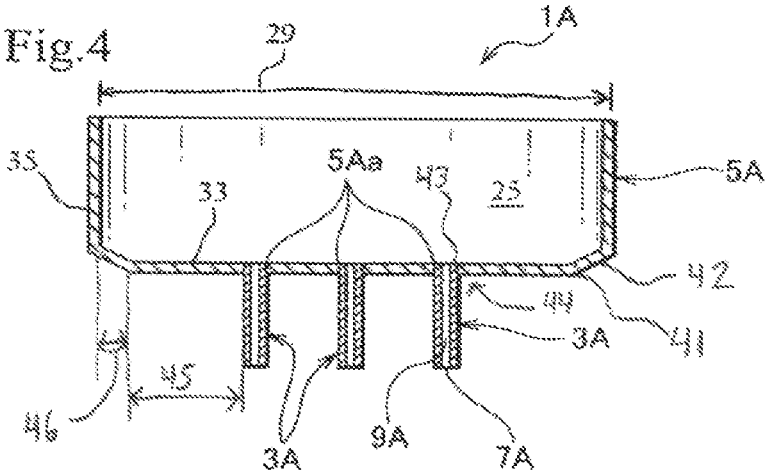
FIG. 4 is a sectional view illustrating the nozzle of FIG. 3.

FIG. 3 is a perspective view illustrating a viscous liquid feed nozzle 1A employing a multi-nozzle configuration according to another embodiment of the present invention and FIG. 4 is a sectional view illustrating the nozzle 1A.

The viscous liquid feed nozzle 1A has a wide port 5A that is larger than the wide port 5 of the nozzle 1 for a plurality of nozzle bodies 3A that protrude from the wide port 5A. More precisely, the wide port 5A has holes 5Aa into which the nozzle bodies 3A are prepared separately from the wide port 5A and are pressed or inserted by pressure, respectively. Instead, the nozzle bodies 3A may be integral with the wide port 5A. The wide port 5A has a flat bottom wall 33 on the base end 44 of the nozzle body and a circumferential wall 35 formed along an outer periphery 41 of the bottom wall, with a shoulder part 42 interposed between the bottom wall 33 and the circumferential wall 35. End faces 43 surround holes 5Aa. Also, distances 45 spanning from the shoulder to proximate nozzle bodies in a radial direction of the wide port are longer than the radial distance 46 defined by the dimension of the shoulder.

The viscous liquid feed nozzle 1A of multi-nozzle configuration has lubricative plated layers that are formed according to the method mentioned above. Namely, the nozzle 1A is immersed in a lubricative plating solution filled in a plating tank and pressure P is applied to pass the solution through holes 9A of the nozzle bodies 3A and discharge the solution out of feed ports 7A of the nozzle bodies 3A. Through these steps, the lubricative plated layer is formed at least on the inside and outside of each feed port 7A.

Effects of the embodiments will be summarized.

The method according to the embodiment forms the lubricative plated layer 11 on the viscous liquid feed nozzle 1 that has the nozzle body 3 having the thin and long hole 9 with a front end serving as the feed port 7 and the wide port 5 formed at a base end of the nozzle body 3 and is used with a viscous liquid feed unit to feed a viscous liquid from the feed port 7. The method includes steps of immersing the nozzle 1 in a plating tank containing a lubricative plating solution, and forming, by electroless plating, the lubricative plated layer 11 at least on the inside and outside of the feed port 7.

Preferably, the method includes further steps of introducing the lubricative plating solution in the wide port 5 of the nozzle 1 immersed in the plating tank, and passing the lubricative plating solution from the wide port 5 through the thin and long hole 9 of the nozzle body 3 by pressurization or gravity to discharge the lubricative plating solution from the feed port 7, thereby forming, by electroless plating, the lubricative plated layer 11.

The method according to the embodiment is capable of easily forming the lubricative plated layer 11 at least on the inside and outside of the feed port 7.

The method according to the embodiment uses the jig 15 having a plurality of holes 13 each supporting the nozzle 1 with the nozzle body 3 passing through the hole 13 and the wide port 5 being oriented upward. The method moves the jig 15 up and down in the plating tank filled with the lubricative plating solution, to apply pressure P onto the plating solution entered in the hole 9 of each nozzle body 3.

Even if the hole 9 is thin and long, the method according to the embodiment surely passes the lubricative plating solution through the hole 9, to surely form the lubricative plated layer 11 on the inside and outside of the feed port 7 of the nozzle body 3.

The viscous liquid feed nozzle 1 according to the embodiment has the lubricative plated layer 11 formed according to the above-mentioned method of the embodiment. The nozzle 1 has the nozzle body 3 having the thin and long hole 9 with the front end serving as the feed port 7 and the wide port 5 formed at the base end of the nozzle body 3. The lubricative plated layer 11 is formed at least on the inside and outside of the feed port 7.

The viscous liquid feed nozzle 1 with the lubricative plated layer 11 is capable of stably feeding a very small quantity of a viscous liquid such as a viscous adhesive.

According to the embodiment, pressure P is applied to pass a lubricative plating solution through the hole 9 (9A). Instead, only immersing the viscous liquid feed nozzle 1 (1A) in a lubricative plating solution is sufficient to pass the lubricative plating solution through the hole 9 (9A) and form the lubricative plated layer 11 at least on the inside and outside of the feed port 7 (7A) because the plating carried out according to the embodiment is electroless plating.

The present invention is also applicable to a viscous liquid feed nozzle that has only a nozzle body (3) without a wide port (5) so that the nozzle body itself serves as a nozzle.

What is claimed is:

1. A liquid feed nozzle, comprising:

nozzle bodies, wherein each of the nozzle bodies is formed as a discrete hollow cylinder spaced from any adjacent nozzle body, and each of the nozzle bodies being provided with a hole and having a front end serving as a feed port, an inner peripheral surface extending straight in a longitudinal direction of the respective nozzle body to define the hole straightly in said longitudinal direction, and a length of the respective nozzle body being at least three times greater than an inner diameter of the respective hole of the nozzle body; the liquid feed nozzle further comprising:

a wide port having a flat bottom wall to which the nozzle bodies are attached so that the nozzle bodies protrude from the bottom wall, a circumferential wall formed along an outer periphery of the bottom wall, and a shoulder part interposed between the bottom wall and the circumferential wall; and a lubricative plated layer formed at least on a surface of an inside and outside of the feed port of each of the nozzle bodies, the lubricative plated layer having a higher lubricating property than a surface on which the lubricative plated layer is formed; and wherein the shoulder part has a dimension in a lateral direction intersecting the longitudinal direction, the dimension being gradually reduced toward the bottom wall from the circumferential wall so that the outer periphery of the bottom wall is positioned inwardly from an inner periphery of the circumferential wall in the lateral direction; and wherein each of the nozzle bodies has an end face of the base end surrounding an opening of the respective hole at the base end of the respective nozzle body, the end face and the opening facing an inside of the wide port and the end face continuing flat to a surface of the bottom wall inside the wide port; and wherein distances spanning from the shoulder to proximate nozzle bodies in a radial direction of the wide port are longer than a radial distance defined by the dimension of the shoulder.

2. The liquid feed nozzle of claim 1, wherein the lubricative plated layer is also formed on an inside surface of the wide port.

3. The liquid feed nozzle of claim 1, wherein the lubricative plated layer is also formed on an outside surface of the wide port.

4. The liquid feed nozzle of claim 1, wherein the lubricative plated layer is also formed on inside and outside surfaces of the wide port.

5. A liquid feed nozzle, comprising:

nozzle bodies, wherein each of the nozzle bodies is formed as a discrete hollow cylinder spaced from any adjacent nozzle body, and each of the nozzle bodies having a hole formed through the respective nozzle body in a longitudinal direction of the respective nozzle body and having a front end serving as a feed port, an inner peripheral surface of the respective nozzle body extending straight in said longitudinal direction to define the hole straightly in said longitudinal direction, and a length of the respective nozzle body in the longitudinal direction to define the hole straightly in said longitudinal direction, and a length of the respective nozzle body in the longitudinal direction being at least three times greater than an inner diameter of the respective hole of the nozzle body; the liquid feed nozzle further comprising:

a wide port having a flat bottom wall to which the nozzle bodies are attached so that the nozzle bodies protrude from the bottom wall, a circumferential wall formed along an outer periphery of the bottom wall, and a shoulder part interposed between the bottom wall and the circumferential wall; a lubricative plated layer formed at least on a surface of an inside and outside of the feed port of each of the nozzle bodies so that the lubricative plated layer continuously extends from an inside of the respective hole through an end edge of the respective nozzle body to an outside of the respective nozzle body, the lubricative plated layer having a higher lubricating property than a surface on which the lubricative plated layer is formed; and wherein the shoulder part has a dimension in a lateral direction intersecting the longitudinal direction, the dimension being gradually reduced toward the bottom wall from the circumferential wall so that the outer periphery of the bottom wall is positioned inwardly from an inner periphery of the circumferential wall in the lateral direction, and wherein each of the nozzle bodies has an end face of the base end surrounding an opening of the respective hole at the base end of the respective nozzle body, the end face and the opening facing an inside of the wide port and the end face continuing flat to a surface of the bottom wall inside the wide port, and wherein distances spanning from the shoulder to proximate nozzle bodies in a radial direction of the wide port are longer than a radial distance defined by the dimension of the shoulder.

6. The liquid feed nozzle of claim 5, wherein the lubricative plated layer is also formed on an inside surface of the wide port.

7. The liquid feed nozzle of claim 5, wherein the lubricative plated layer is also formed on an outside surface of the wide port.

8. The liquid feed nozzle of claim 5, wherein the lubricative plated layer is also formed on inside and outside surfaces of the wide port.

9. A liquid feed nozzle, comprising:

nozzle bodies, wherein each of the nozzle bodies is formed as a discrete hollow cylinder spaced from any adjacent nozzle body, and each of the respective nozzle bodies being provided with a hole and having a front end serving as a feed port, an inner peripheral surface extending straight in a longitudinal direction of the respective nozzle body to define the hole straightly in said longitudinal direction, and a length of the respective nozzle body being at least three times greater than an inner diameter of the respective hole of the nozzle body; the liquid feed nozzle further comprising:

a wide port; and a lubricative plated layer formed at least on a surface of an inside and outside of the feed port of each of the nozzle bodies, the lubricative plated layer having a higher lubricating property than a surface on which the lubricative plated layer is formed;

wherein the wide port has a flat bottom wall on the base end of the nozzle body, a circumferential wall formed along an outer periphery of the bottom wall, respective attaching holes formed through the bottom wall to which each respective nozzle body is attached, and a shoulder part interposed between the bottom wall and the circumferential wall, wherein the shoulder part has a dimension in a lateral direction intersecting the longitudinal direction, the dimension being gradually reduced toward the bottom wall from the circumferential wall so that the outer periphery of the bottom wall is positioned inwardly from an inner periphery of the circumferential wall in the lateral direction, and wherein each of the nozzle bodies has an end face of the base end surrounding an opening of the respective hole at the base end of the respective nozzle body and the base end of the respective nozzle body is inserted into one of the respective attaching holes of the bottom wall so that the end face and the opening face an inside of the wide port and the end face continues flat to a surface of the bottom wall inside the wide port, and wherein distances spanning from the shoulder to proximate nozzle bodies in a radial direction of the wide port are longer than a radial distance defined by the dimension of the shoulder.

10. The liquid feed nozzle of claim 9, wherein the lubricative plated layer is also formed on an inside surface of the wide port.

11. The liquid feed nozzle of claim 9, wherein the lubricative plated layer is also formed on an outside surface of the wide port.

12. The liquid feed nozzle of claim 9, wherein the lubricative plated layer is also formed on inside and outside surfaces of the wide port.

* * * * *